US009050734B2

(12) United States Patent
Mazursky et al.

(10) Patent No.: US 9,050,734 B2
(45) Date of Patent: Jun. 9, 2015

(54) APPARATUS FOR PROVIDING BUILT-IN INDICATOR FLAGS

(71) Applicant: PDQ Mazoo, LLC, Riverwoods, IL (US)

(72) Inventors: Richard B. Mazursky, Riverwoods, IL (US); Joseph Dale Martens, Chicago, IL (US)

(73) Assignee: PDQ Mazoo, LLC, Riverwoods, IL (US)

( * ) Notice: Subject to any disclaimer, the term of this patent is extended or adjusted under 35 U.S.C. 154(b) by 105 days.

(21) Appl. No.: 13/675,705

(22) Filed: Nov. 13, 2012

(65) Prior Publication Data

US 2013/0118016 A1 May 16, 2013

Related U.S. Application Data

(60) Provisional application No. 61/559,515, filed on Nov. 14, 2011, provisional application No. 61/564,697, filed on Nov. 29, 2011.

(51) Int. Cl.

| | |
|---|---|
| ***B26F 1/14*** | (2006.01) |
| ***B26B 11/00*** | (2006.01) |
| ***B26B 7/00*** | (2006.01) |
| ***B26F 1/22*** | (2006.01) |
| ***B26F 1/36*** | (2006.01) |
| *B26D 7/26* | (2006.01) |
| *B26D 1/30* | (2006.01) |
| *B26D 7/01* | (2006.01) |
| *B41K 1/00* | (2006.01) |
| *B26D 7/00* | (2006.01) |

(52) U.S. Cl.

CPC . *B26F 1/14* (2013.01); *B26B 11/00* (2013.01); *B26B 7/00* (2013.01); *B26F 1/22* (2013.01); *B26F 1/36* (2013.01); *B26D 7/2614* (2013.01); *B26D 1/305* (2013.01); *B26D 7/016* (2013.01); *B41K 1/00* (2013.01); *B26D 2007/0087* (2013.01); *B26D 2007/0093* (2013.01)

(58) Field of Classification Search

USPC ..... 101/26

See application file for complete search history.

(56) References Cited

U.S. PATENT DOCUMENTS

| | | | | | |
|---|---|---|---|---|---|
| 1,528,819 | A | * | 3/1925 | Engel | 101/3.1 |
| 1,802,377 | A | * | 4/1931 | Glass | 101/19 |
| 2,053,473 | A | * | 9/1936 | Gould et al. | 101/26 |
| 2,124,870 | A | * | 7/1938 | Altvater et al. | 101/26 |
| 2,630,863 | A | * | 3/1953 | Hooe | 101/19 |
| 2,858,889 | A | * | 11/1958 | Kent | 234/52 |
| 3,065,691 | A | * | 11/1962 | Sohn | 101/227 |
| 3,154,010 | A | * | 10/1964 | Rudy | 101/31.1 |
| 3,170,390 | A | * | 2/1965 | Wagner | 101/19 |
| 3,276,355 | A | * | 10/1966 | Carter | 101/26 |
| 3,289,573 | A | * | 12/1966 | Apicella | 101/27 |

(Continued)

*Primary Examiner* — Jill Culler

(74) *Attorney, Agent, or Firm* — McAndrews, Held & Malloy, Ltd.

(57) ABSTRACT

Certain embodiments provide an apparatus for integrating an indicator flag into an item. The apparatus includes an upper portion and a base. The upper portion includes a cutting blade and a first attachment. The cutting blade is operable to cut the indicator flag into the item. The base includes a second attachment and one or more cutting grooves. The second attachment is operable to couple with the first attachment such that upper portion is movable towards the base. The one or more cutting grooves are operable to mate with the cutting blade when the upper portion is depressed and the upper portion moves towards the base.

23 Claims, 15 Drawing Sheets

(56) References Cited

U.S. PATENT DOCUMENTS 3,584,572 A * 6/1971 Apicella ..... 101/30
5,622,106 A * 4/1997 Rayner ..... 101/32
7,878,115 B2 * 2/2011 Yamashita et al. ..... 101/30
2013/0036637 A1 * 2/2013 Mazursky ..... 40/359

* cited by examiner

APPARATUS FOR PROVIDING BUILT-IN INDICATOR FLAGS

CROSS-REFERENCE TO RELATED APPLICATIONS/INCORPORATION BY REFERENCE

This patent application makes reference to, claims priority to and claims benefit from U.S. Provisional Patent Application Ser. No. 61/559,515, entitled "Apparatus for Providing Built-In Indicator Flags," filed on Nov. 14, 2011, and U.S. Provisional Patent Application Ser. No. 61/564,697, entitled "Apparatus for Providing Built-In Indicator Flags," filed on Nov. 29, 2011, the entire contents of each prior-filed application is hereby expressly incorporated by reference herein.

U.S. patent application Ser. No. 13/205,173, entitled "Built-In Indicator Flags," filed on Aug. 8, 2011, by Mazursky is hereby incorporated by reference in its entirety.

FEDERALLY SPONSORED RESEARCH OR DEVELOPMENT

[Not Applicable]

SEQUENCE LISTING

[Not Applicable]

MICROFICHE/COPYRIGHT REFERENCE

[Not Applicable]

BACKGROUND OF THE INVENTION

The present invention generally relates to indicator flags. More specifically, certain embodiments disclose an apparatus for providing one or more indicator flags integrated into an item for identifying important information or locations. The one or more indicator flags built into the item are constructed such that extra material is not required for providing the indicator flags while the integrity of the item is substantially maintained.

Currently, a variety of products and methods are used to identify particular items and information or locations associated with items. For example, an individual reading a book may fold down a corner of a page or use a bookmark to mark where the individual stopped reading so that the location can be readily found when the individual is ready to resume reading. However, bookmarks are easily lost and often times fall out of the book, causing frustration and wasted time attempting to identify the location the individual stopped reading. Further, folded corners may come undone or be confused with other folded corners. Also, folded corners are not easily identifiable and compromise the integrity of the folded pages.

As another example, self-stick notes and flags are commonly attached to documents to identify particular documents or areas of a document that is of interest. Typically, self-stick notes and flags are strips of paper or plastic with adhesive on a portion of one side. However, using self-stick notes and flags can become expensive because each marked page or portion of a page may require a separate self-stick note or flag. Additionally, self-stick notes and flags are not reusable and once the adhesive dries out or becomes sullied, a new self-stick note or flag is needed. Self-stick notes and flags are prone to falling from their designated papers or locations, for example, if the papers are moved around significantly or when the adhesive dries out. The self-stick notes and flags also attach additional bulk or material to the document. As such, depending on the size and thickness of the notes and flags, the self-stick notes and flags could create a problem with stacking a collection of documents.

Further, when using a filing system, a user removing a file from the filing system may desire to mark the location of the removed file so that it can be placed back in the appropriate location. Additionally or alternatively, particular files or information in particular files may need to be identified. Various devices for temporarily or permanently attaching to folders or other items are currently known. However, known permanently attached identifiers add bulk, require additional manufacturing processes and add greater costs to the folder or other item. The added bulk to the folder or other item is problematic when attempting to stack the items and may compromise the integrity of the item. Further, the added bulk of permanently attached identifiers may require less of the item to be shipped per container and/or may require a specially sized shipping container. Additionally, the use of additional material for each item may significantly add to the cost of the item. With regard to temporarily attached identifiers, such identifiers may become easily detached and large quantities of the temporarily attached identifiers may be necessary depending on the number of items or portions of items that need to be marked, driving up the cost to use the temporarily attached identifiers.

U.S. patent application Ser. No. 13/205,173 by Mazursky discloses one or more indicator flags integrated into an item for identifying important information or locations, where the one or more indicator flags built into the item are constructed such that extra material is not required for providing the indicator flags while the integrity of the item is substantially maintained. However, there is a need for an apparatus for integrating the indicator flags into existing items that are in possession of an end user.

Further limitations and disadvantages of conventional and traditional approaches will become apparent to one of skill in the art, through comparison of such systems and methods with the present invention as set forth in the remainder of the present application with reference to the drawings.

BRIEF SUMMARY OF THE INVENTION

An apparatus for integrating indicator flag(s) for identifying important information or locations into an item are provided, substantially as shown in and/or described in connection with at least one of the figures, as set forth more completely in the claims.

These and other advantages, aspects and novel features of the present invention, as well as details of illustrative aspects thereof, will be more fully understood from the following description and drawings.

Figure 1:
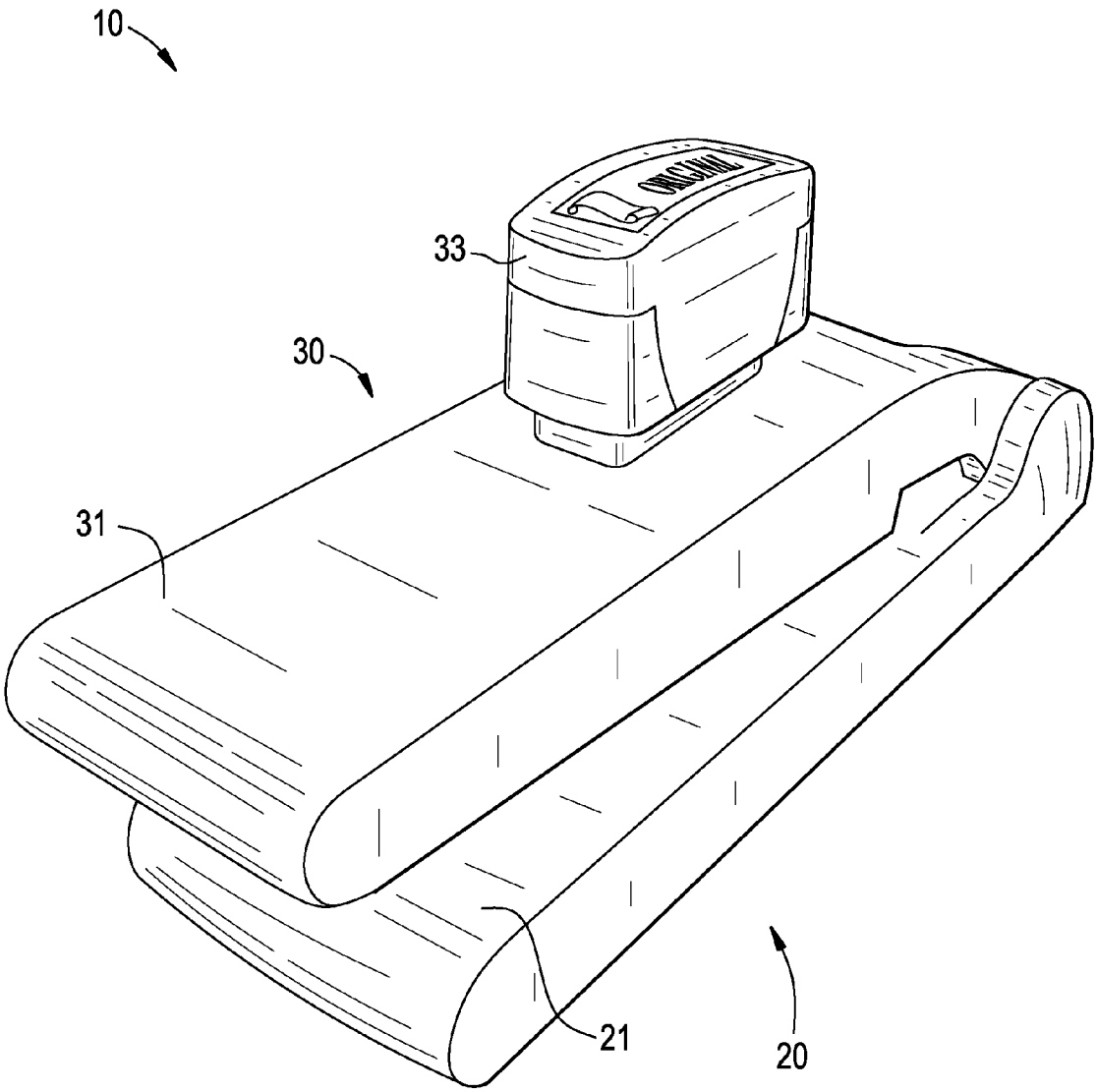
FIG. 1 is a perspective view of a first exemplary apparatus in a closed position for providing indicator flags in accordance with an embodiment of the present invention.

The foregoing summary, as well as the following detailed description of certain embodiments of the present invention, may be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Certain embodiments of the present invention relate to an apparatus 10, 100 for integrating indicator flags into an item (e.g., a folder, book page, document, label, etc.) for identifying important information and/or locations. The apparatus 10, 100 comprises an upper portion 30, 140 and a base 20, 120. The upper portion 30, 140 comprises a cutting blade 35, 190 and a first attachment 36, 143. The cutting blade 35, 190 is operable to cut the indicator flag into the item. The base 20, 120 comprises a second attachment 25, 124 and one or more cutting grooves 22, 131. The second attachment 25, 124 is operable to couple with the first attachment 36, 143 such that upper portion 30, 140 is movable towards the base 20, 120. The one or more cutting grooves 22, 131 are operable to mate with the cutting blade 35, 190 when the upper portion 30, 140 is depressed and the upper portion 30, 140 moves towards the base 20, 120.

Figure 2:
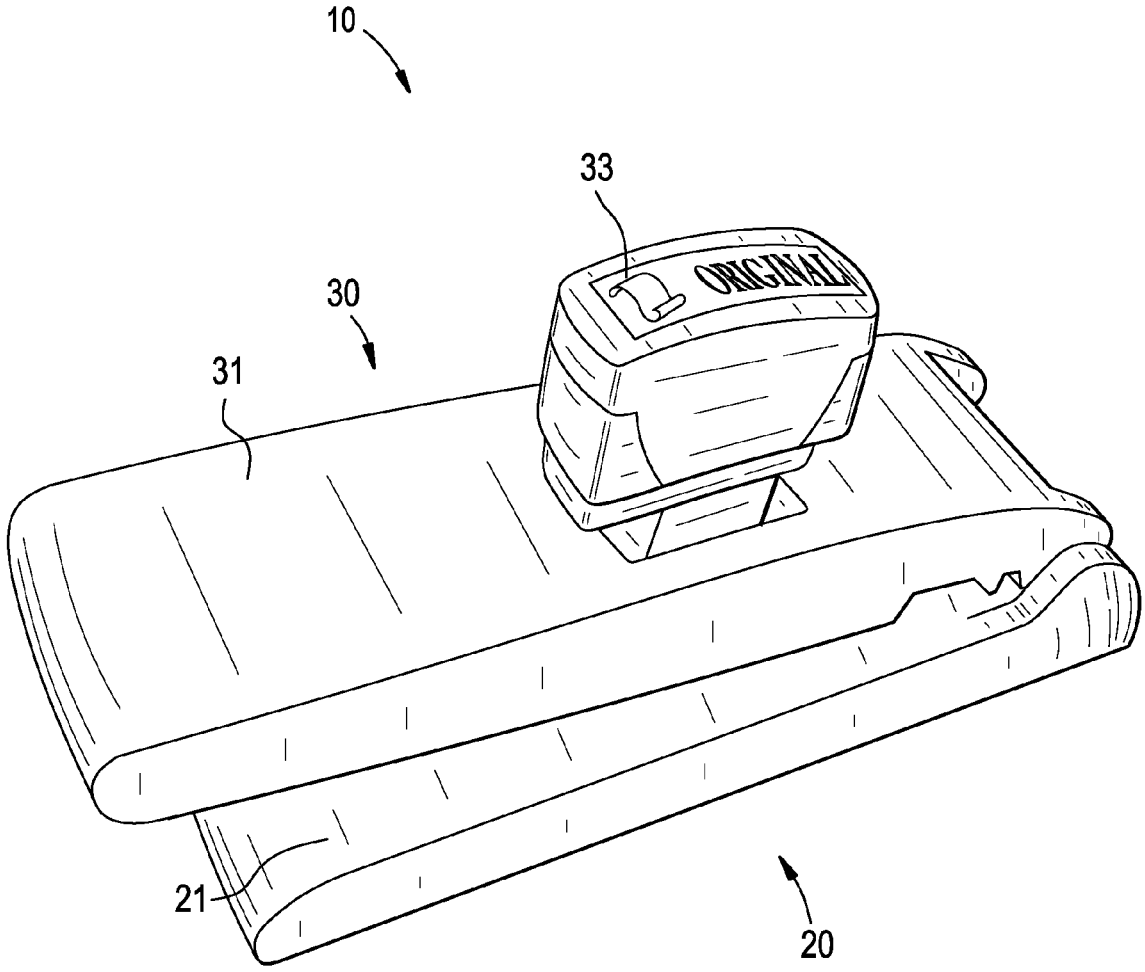
FIG. 2 is a side view of a first exemplary apparatus in a closed position for providing indicator flags in accordance with an embodiment of the present invention.
Figure 3:
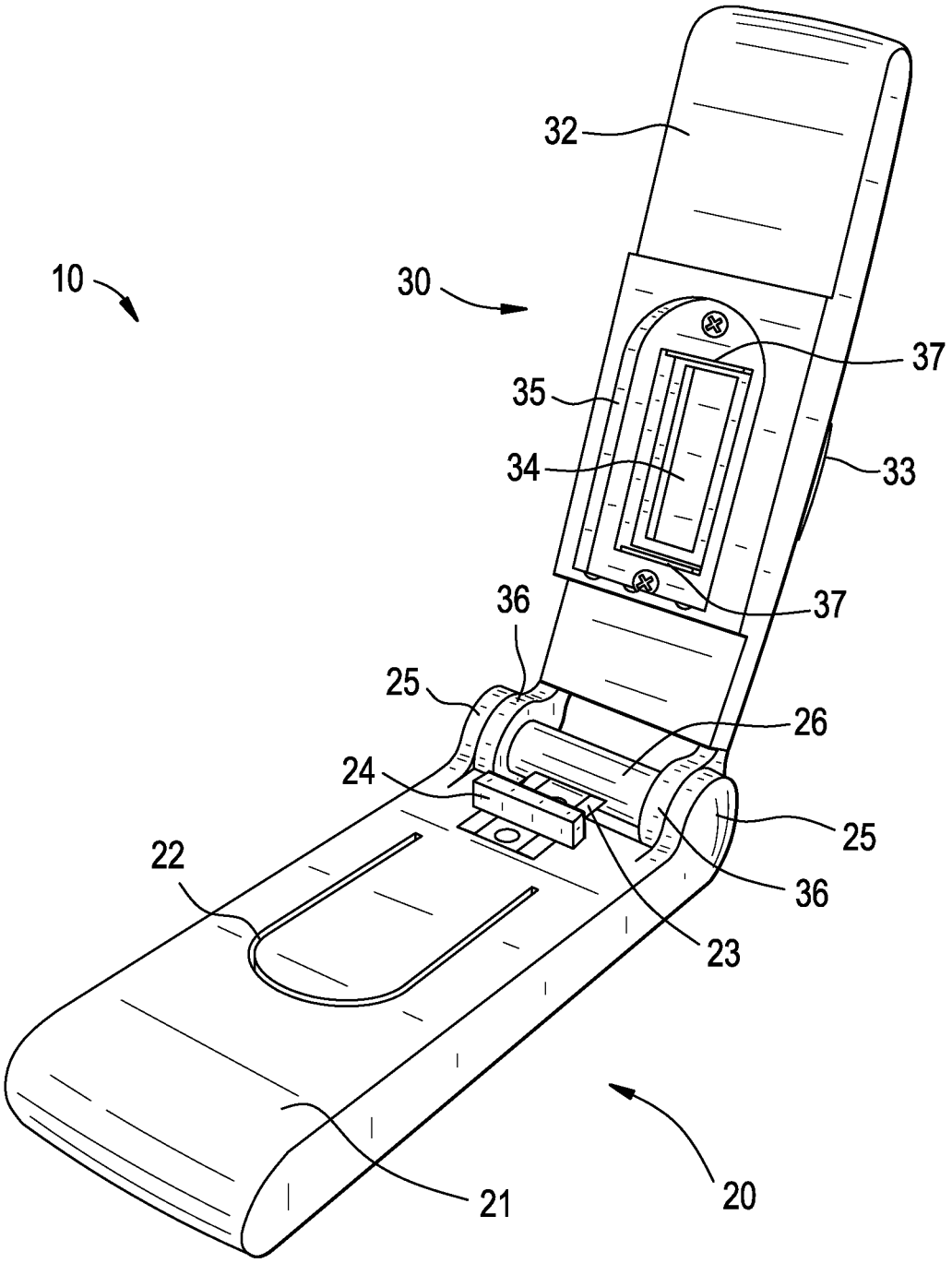
FIG. 3 is a perspective view of a first exemplary apparatus in an open position for providing indicator flags in accordance with an embodiment of the present invention.
Figure 4:
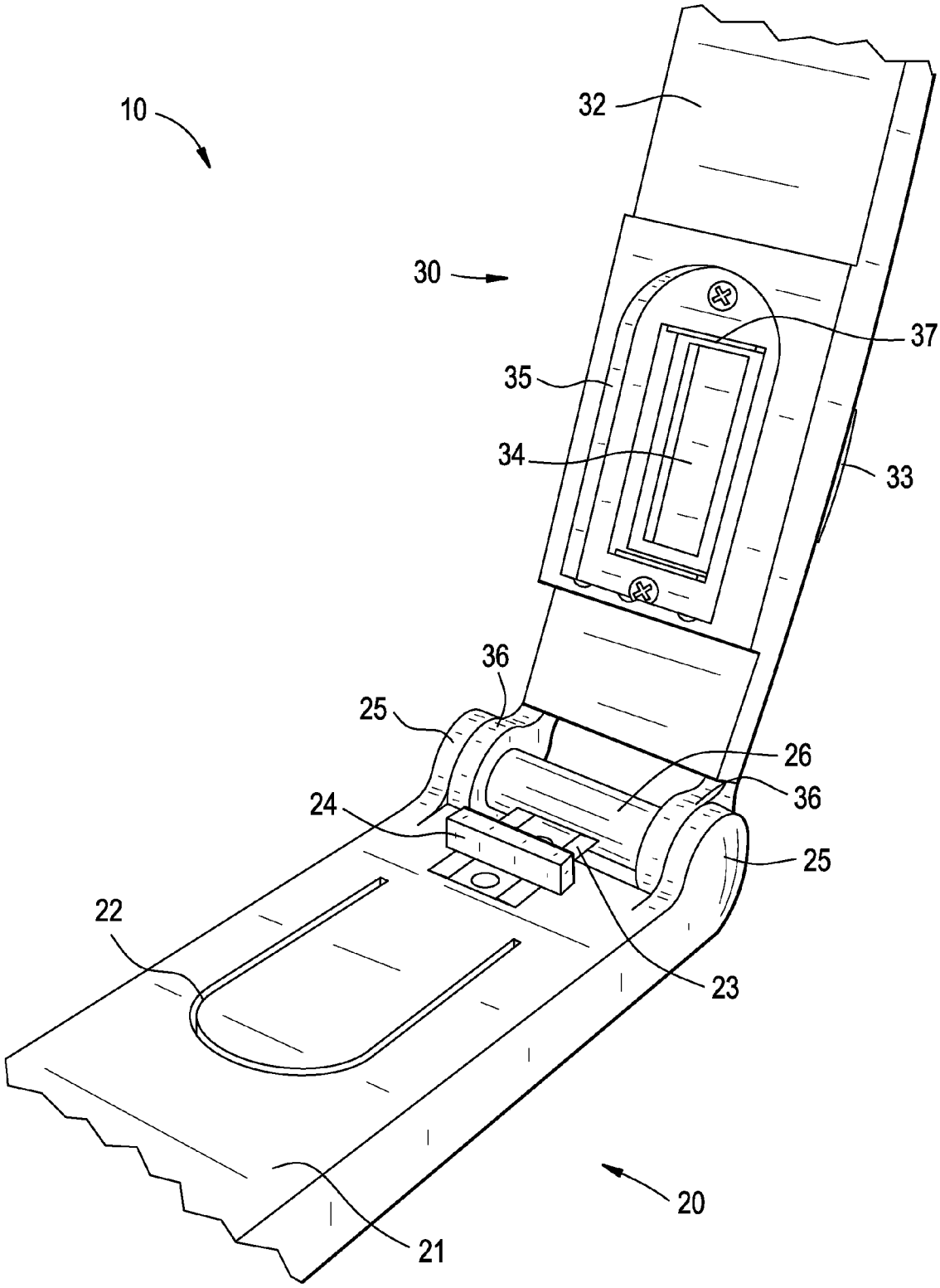
FIG. 4 is a perspective view of a first exemplary apparatus in an open position for providing indicator flags in accordance with an embodiment of the present invention.
Figure 5:
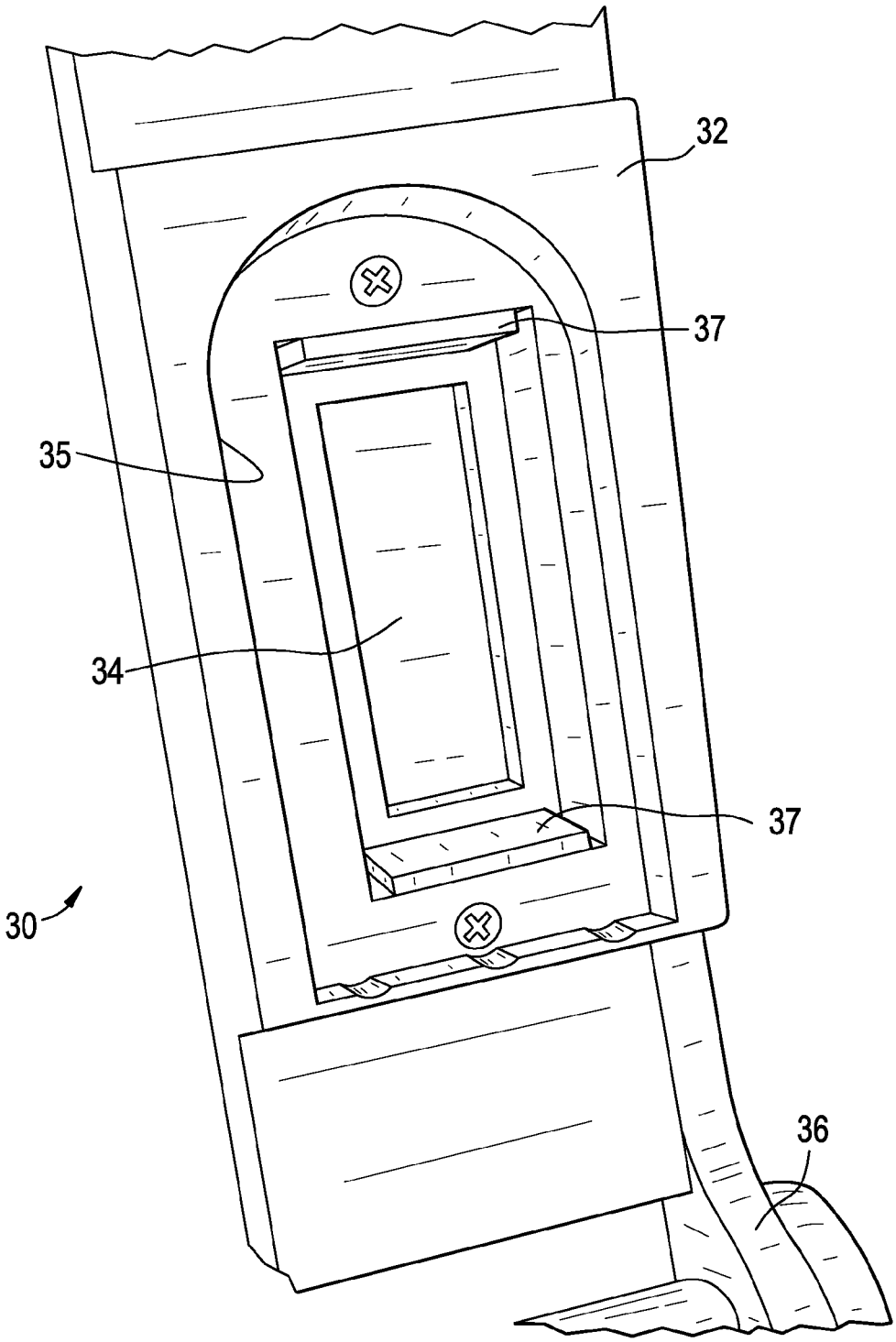
FIG. 5 is a close-up view of a bottom surface of an upper portion of a first exemplary apparatus for providing indicator flags in accordance with an embodiment of the present invention.
Figure 6:
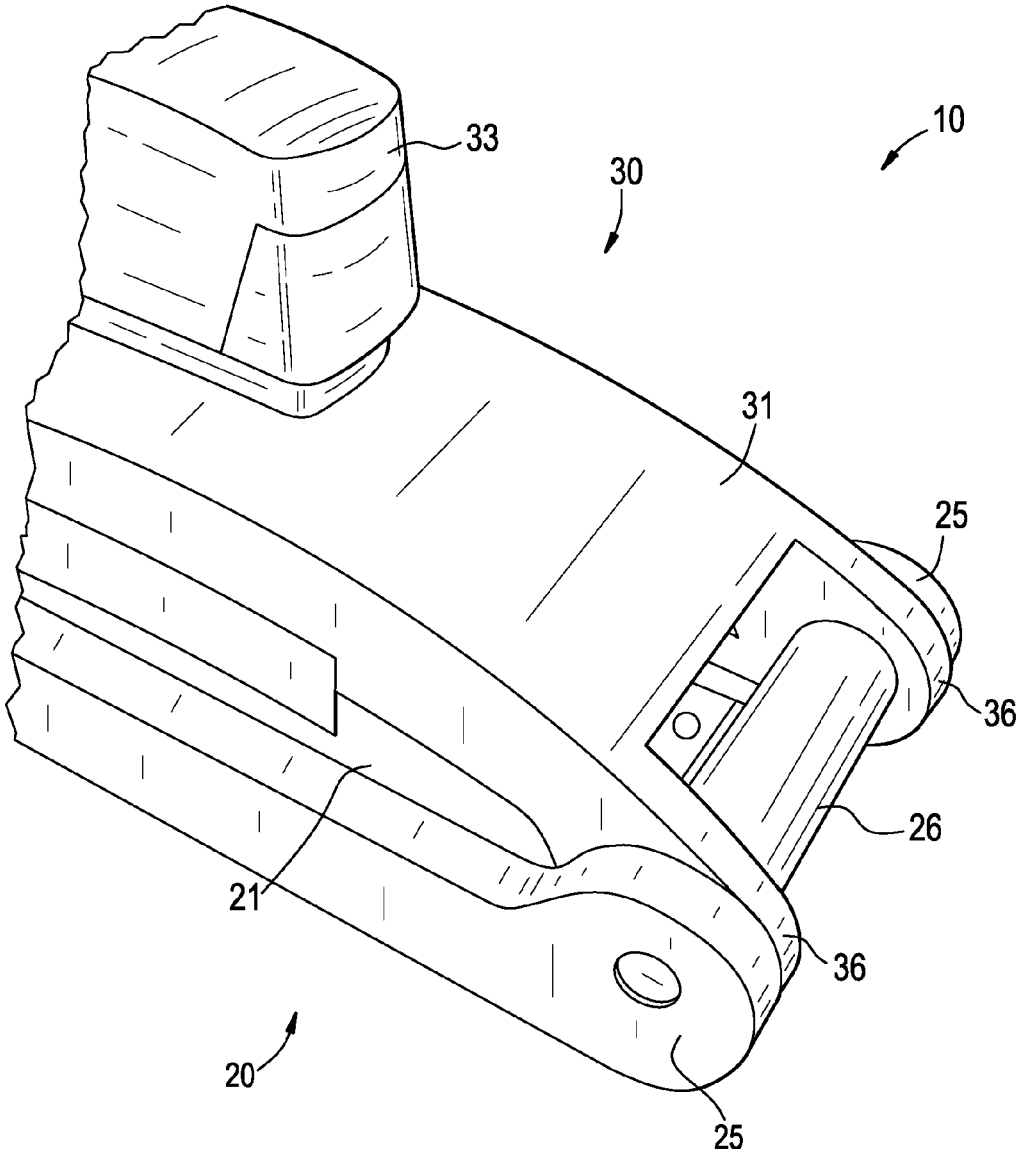
FIG. 6 is a close-up view of an exemplary attachment mechanism for attaching an upper portion to a base of a first exemplary apparatus for providing indicator flags in accordance with an embodiment of the present invention.

FIGS. 1-2 are views of a first exemplary apparatus 10 in a closed position for providing indicator flags in accordance with an embodiment of the present invention. FIGS. 3-4 are perspective views of a first exemplary apparatus 10 in an open position for providing indicator flags. FIG. 5 is a close-up view of a bottom surface 32 of an upper portion 30 of a first exemplary apparatus 10 for providing indicator flags. FIG. 6 is a close-up view of an exemplary attachment mechanism 25, 26, 36 for attaching an upper portion 30 to a base 20 of a first exemplary apparatus 10 for providing indicator flags.

Referring to FIGS. 1-6, an apparatus 10 for providing indicator flags is illustrated. The apparatus 10 comprises a base 20 and an upper portion 30. In various embodiments, the apparatus 10 may be a handheld apparatus and/or may be operated by placing the base 20 on a flat surface, among other things.

The base 20 comprises an upper surface 21, cutting grooves 22, one or more notches 23, a distance stop 24, and attachments 25. As illustrated in FIGS. 3-4, the cutting grooves 22 may be integrated in the upper surface 21. In various embodiments, the cutting grooves 22 may include grooves for mating with a plurality of cutting blade 35 configurations. In certain embodiments, the cutting grooves 22 may be integrated into a cutting base that is attached to the upper surface 21 of the base 20 as discussed, for example, in U.S. Provisional Application Ser. No. 61/559,515 by Mazursky, and as discussed below with regard to FIGS. 7-15. The cutting base may be detachably coupled to the upper surface 21 such that a cutting base with a cutting groove 22 design matching the cutting blade 35 design is attached to the upper surface 21 of the base 20. Additionally and/or alternatively, cutting grooves 22 integrated into a cutting base may include grooves for mating with a plurality of cutting blade 35 configurations.

As illustrated in FIGS. 3-4, one or more notches 23 may be integrated in the upper surface 21 of the base 20. A distance stop 24 is adjustably attached to the one or more notches 23 such that the position of a tab being cut into an item using the apparatus 10 may be adjustably selected. For example, setting the distance stop 24 in the one or more notches 23 towards the front of the apparatus 10 allows a flag to be cut near an edge of an item such that the flag, when in an open position, extends at a longer distance beyond the item edge as described in U.S. patent application Ser. No. 13/205,173 by Mazursky. As another example, setting the distance stop 24 in the one or more notches 23 towards the back of the apparatus 10 allows a flag to be cut farther from the edge of the item such that the flag, when in an open position, extends at a shorter distance beyond the item edge as also described in U.S. patent application Ser. No. 13/205,173 by Mazursky.

The upper portion 30 comprises a top surface 31 and a bottom surface 32. In certain embodiments, the top surface 31 comprises an opening that extends through the bottom surface 32 for integrating a stamp 33. In various embodiments, the stamp 33 may be an ink stamp, a marking stamp, a printing stamp, a spring loaded ink stamp, or any other suitable stamping mechanism. In certain embodiments, the stamp 33 may comprise an ink pad 34, among other things, for stamping one or more of letters, numbers, words, designs, colors, among other things, on an indicator flag as described in U.S. patent application Ser. No. 13/205,173 by Mazursky, for example. The stamp 33 is removable and may be secured in opening by one or more bosses 37. For example, stamp 33 may be removed and replaced if the ink pad 34 dried out. As another example, stamp 33 may be removed and replaced with stamps 33 having ink pads 34 with various colors and/or stamp messages (e.g., letters, numbers, words, designs, etc.).

The upper portion 30 comprises attachments 36 for coupling with attachments 25 of the base 20 such that the upper portion 30 is movable towards base 20. For example, as illustrated at least in FIGS. 3-4 and 6, a pin, bolt or any suitable attachment mechanism may extend through attachments 25, 36 thereby rotatably attaching the upper portion 30 to the base 20. As another example, the upper portion 30 may include pivot knobs that couple with pivot holes of the inner surfaces of the pivot arms 25 such that the upper portion 30 is rotatably attached to the base 20 as described in U.S. Provisional Application Ser. No. 61/559,515 by Mazursky, and as discussed below with regard to FIGS. 7-15. Unless so claimed, the scope of various aspects of the present invention should not be limited to an attachment mechanism for coupling the upper portion 30 to the base 20 such that the upper portion 30 is movable towards the base 20.

In various embodiments, the bottom surface 32 of the upper portion 30 comprises a cutting blade 35, an ink pad 34 and one or more bosses 37. The cutting blade 35 comprises one or more blades. In certain embodiments, the cutting blade 35 may include one or more perforation blades, aperture blades, score blades, and/or any other suitable blades for cutting a flag in an item as described, for example, in U.S. Provisional Application Ser. No. 61/559,515 by Mazursky and U.S. patent application Ser. No. 13/205,173 by Mazursky. The cutting blade 35 is detachably coupled to the bottom surface 32 of the upper portion 30. For example, if blades of the cutting blade 35 become worn or if a different blade configuration is desired, the cutting blade 35 may be replaced by a new and/or differently configured cutting blade 35. In certain embodiments, if the cutting blade 35 is replaced with a differently configured cutting blade 35, a cutting base with a matching cutting groove 22 design may be replaced on the upper surface 21 of the base 20 such that the cutting blade 35 mates with the cutting grooves 22 when the upper portion 30 is depressed. Additionally and/or alternatively, the cutting grooves 22 integrated into the upper surface 21 of the base (or a cutting base) may include grooves for mating with a plurality of cutting blade 35 configurations. Certain embodiments may provide a cutting blade shield (not shown) on the bottom surface 32 of the upper portion 30 to protect a user from injury by the cutting blade 35.

In certain embodiments, the bottom surface 32 comprises an opening for receiving an ink pad 34 of the stamp 33. In various embodiments, the stamp 33 may be an ink stamp, a marking stamp, a printing stamp, a spring loaded ink stamp, or any other suitable stamping mechanism. In certain embodiments, the stamp 33 may comprise the ink pad 34, among other things, for stamping one or more of letters, numbers, words, designs, colors, among other things, on an indicator flag as described in U.S. patent application Ser. No. 13/205,173 by Mazursky, for example. The stamp 33 can be removable and may be secured in the opening by one or more bosses 37. For example, the stamp 33 may be removed and replaced if the ink pad 34 dried out. As another example, the stamp 33 may be removed and replaced with stamps 33 having ink pads 34 with various colors and/or stamp messages (e.g., letters, numbers, words, designs, etc.).

In various embodiments, the upper portion 30 may be manually depressed towards the base 20 (i.e., from an open position to a closed position) to cut the indicator flag into an item using the cutting blade 35. As illustrated in FIGS. 1-2 for example, the upper portion 30 may be longer than the base 20 to provide more leverage when the upper portion 30 is depressed. In certain embodiments, the apparatus 10 may include a motor (not shown) for extending the cutting blade 35 towards the upper surface 21 of the base 20 to cut an indicator flag into an item. In various embodiments, the apparatus 10 may include a motor (not shown) for depressing the upper portion 30 towards the base 20 at attachments 25, 26, 36. The motor may be activated by a press and cut switch, for example. The apparatus 10 may be manually powered or electrically powered. For example, the apparatus 10 may be powered by direct current (e.g., batteries) or alternating current. In certain embodiments, inserting an item into the apparatus 10 activates a switch (not shown) for cutting the indicator flag.

In operation, a desired length an indicator flag is to extend beyond an edge of an item is selected by sliding and/or adjusting the distance stop 24 in one or more notches 23. The item is then inserted between the upper portion 30 and the base 20 until the inserted edge of item abuts the distance stop 24. Once the item is properly inserted and aligned in the apparatus 10, the upper portion 30 is depressed. The depression of the upper portion 30 causes the upper portion 30 to move towards the base 20 at the attachments 25, 26, 36 and creates a downward force on the upper portion 30 towards the base 20. As the upper portion 30 moves downward towards the base 20, the cutting blade 35 cuts an indicator flag into the item and mates with grooves 22 of the upper surface 21 of the base 20. During or after cutting the indicator flag into the item, if it is desired that the indicator flag includes a stamp, the stamp 33 is depressed such that the ink pad 34, or any other suitable stamping mechanism, extends towards the upper surface 21 of the base 20 and provides a stamp to the indicator flag. After the indicator flag is cut (and optionally stamped), the upper portion 30 may be lifted to an open position such that the item with the indicator flag (and optionally, stamp) may be removed from the apparatus 10.

Figure 7:
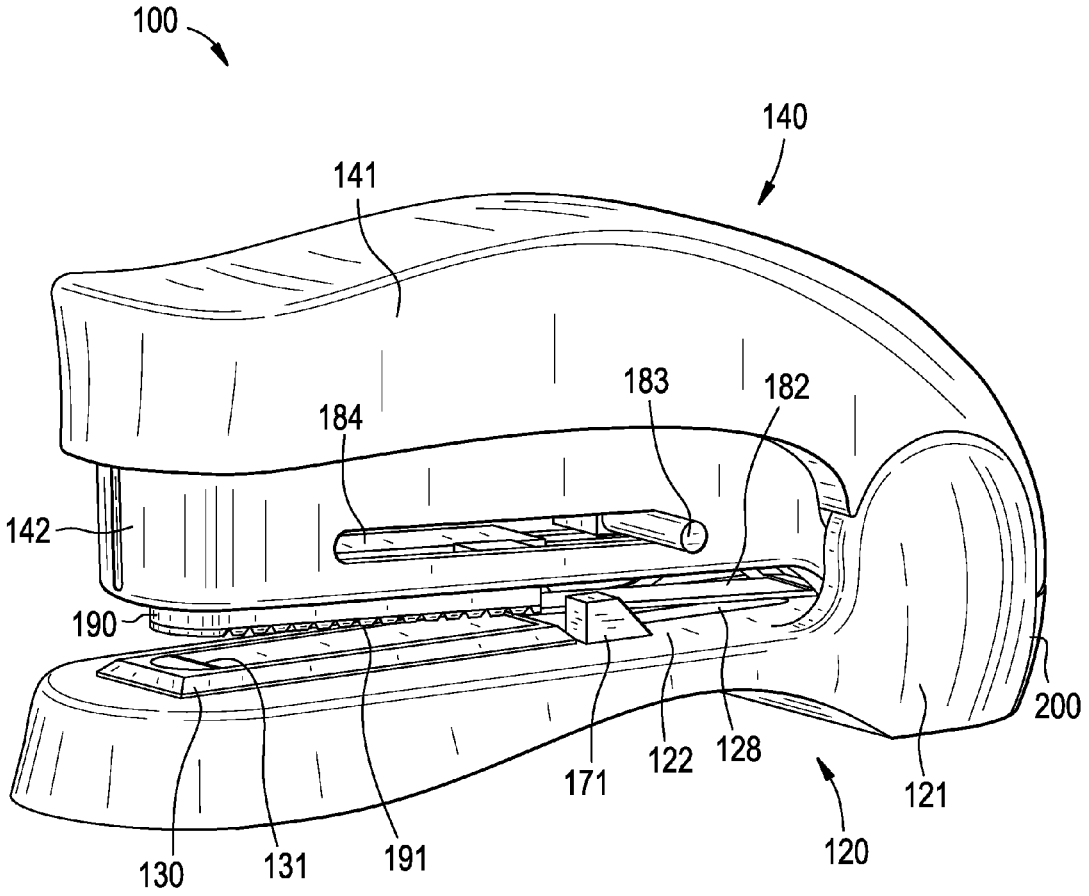
FIG. 7 is a perspective view of a second exemplary apparatus for providing indicator flags in accordance with an embodiment of the present invention.
Figure 8:
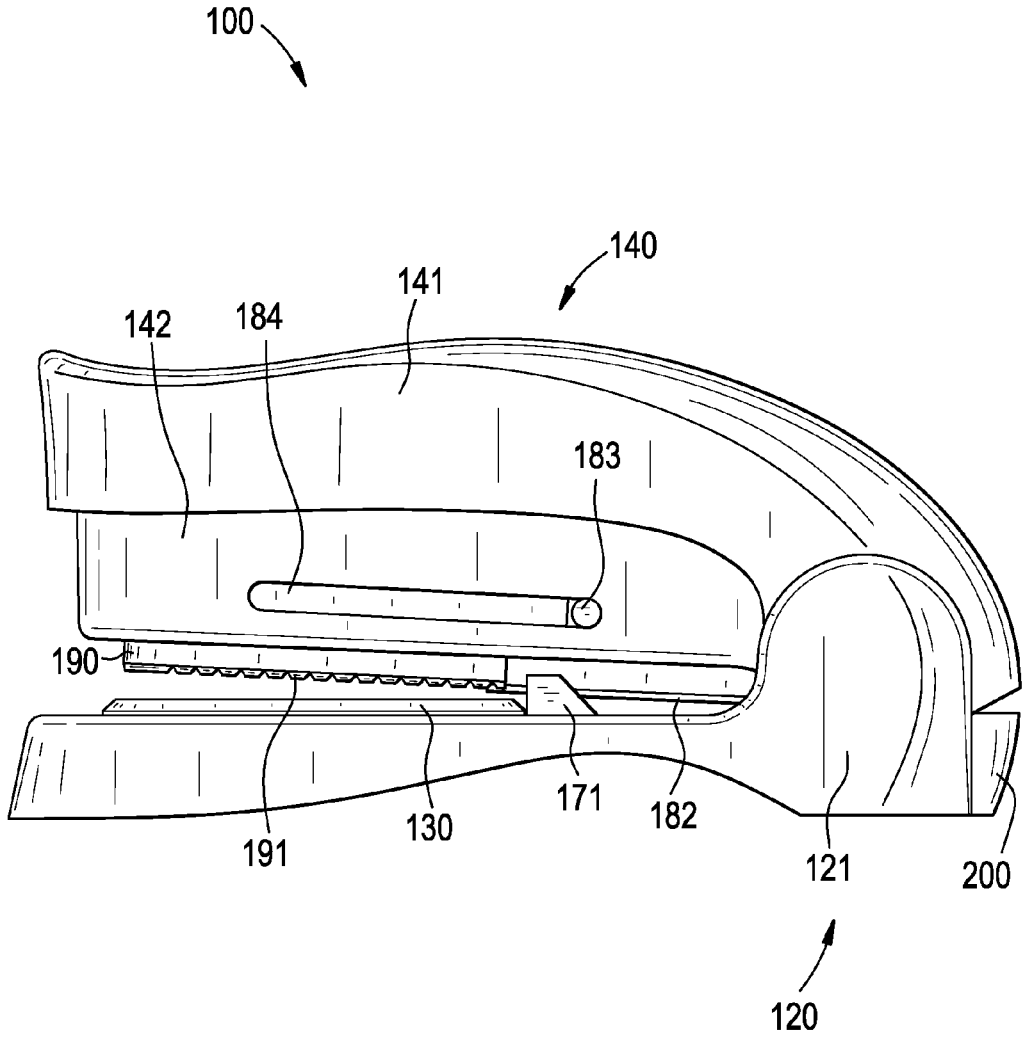
FIG. 8 is a side view of a second exemplary apparatus for providing indicator flags in accordance with an embodiment of the present invention.
Figure 9:
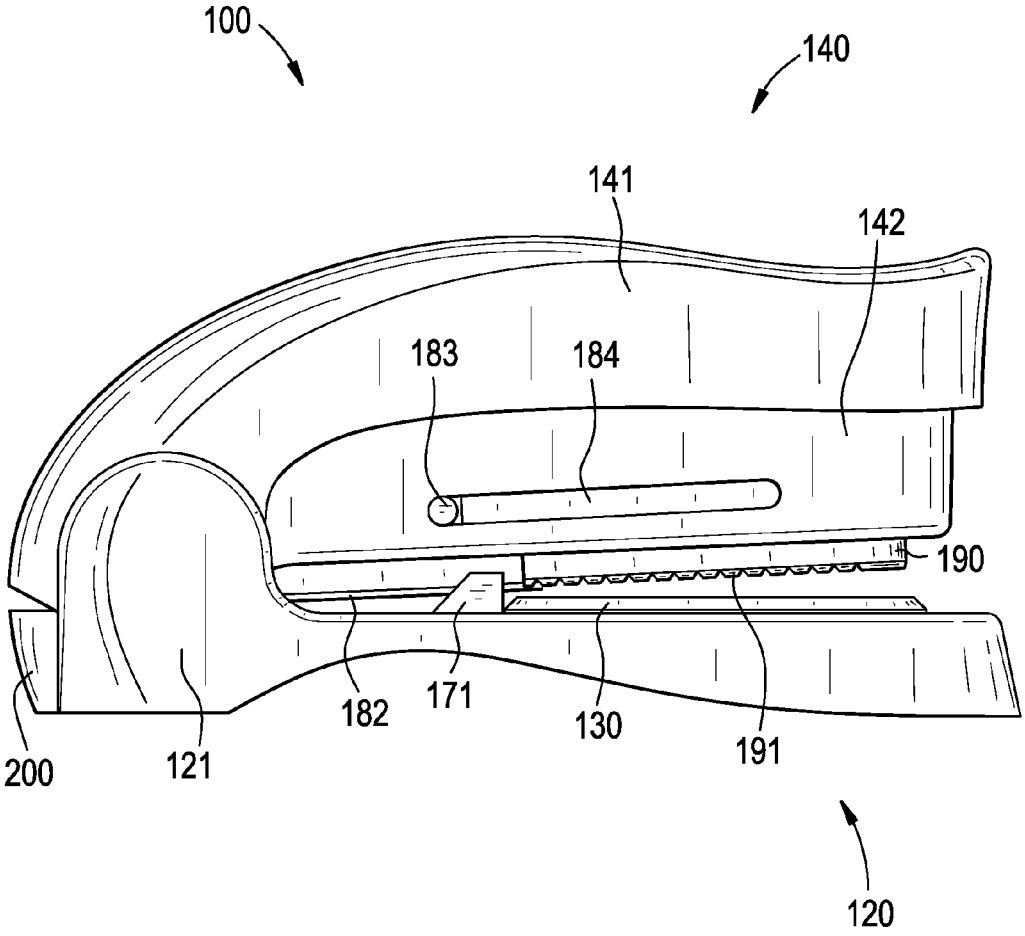
FIG. 9 is a side view of a second exemplary apparatus for providing indicator flags in accordance with an embodiment of the present invention.
Figure 10:
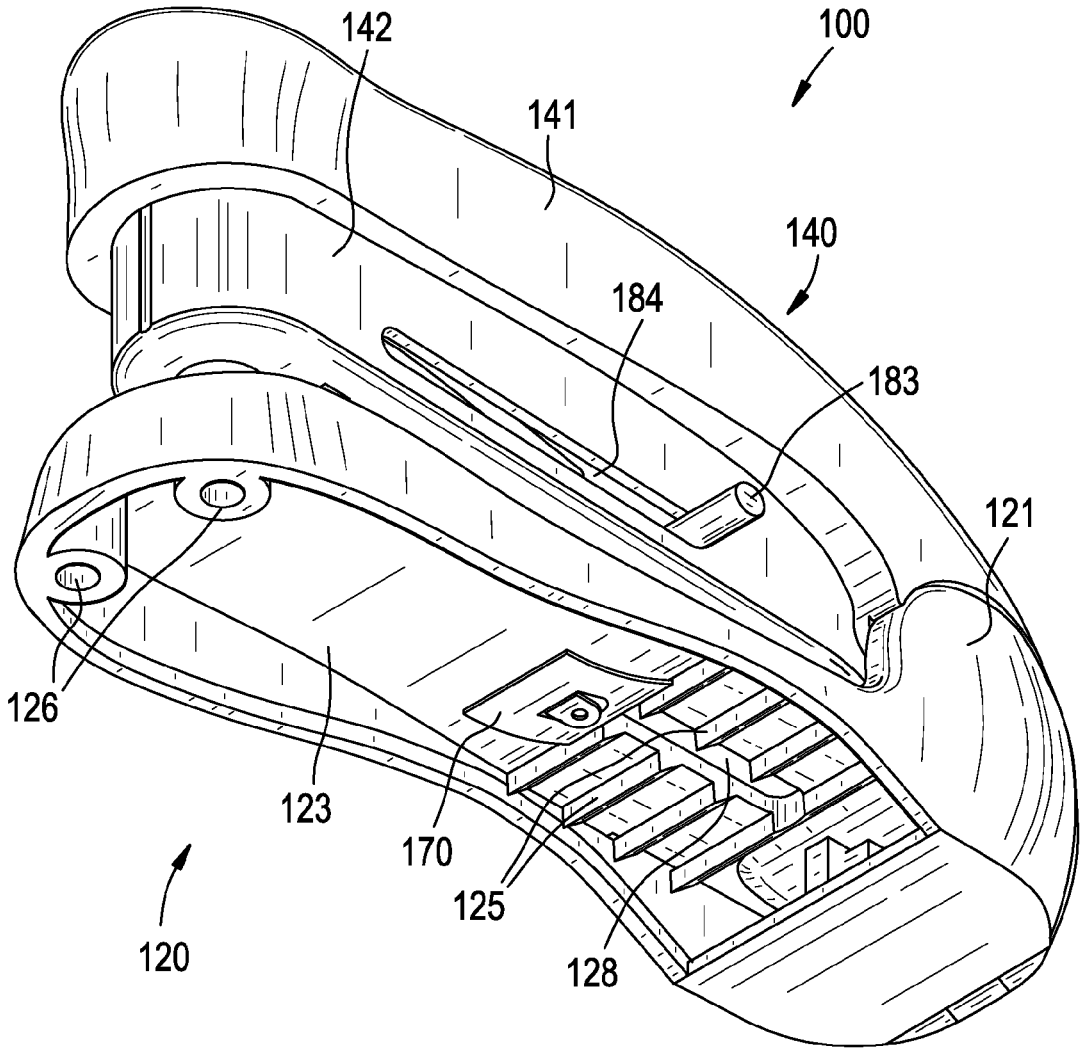
FIG. 10 is a perspective view of a second exemplary apparatus for providing indicator flags in accordance with an embodiment of the present invention.
Figure 11:
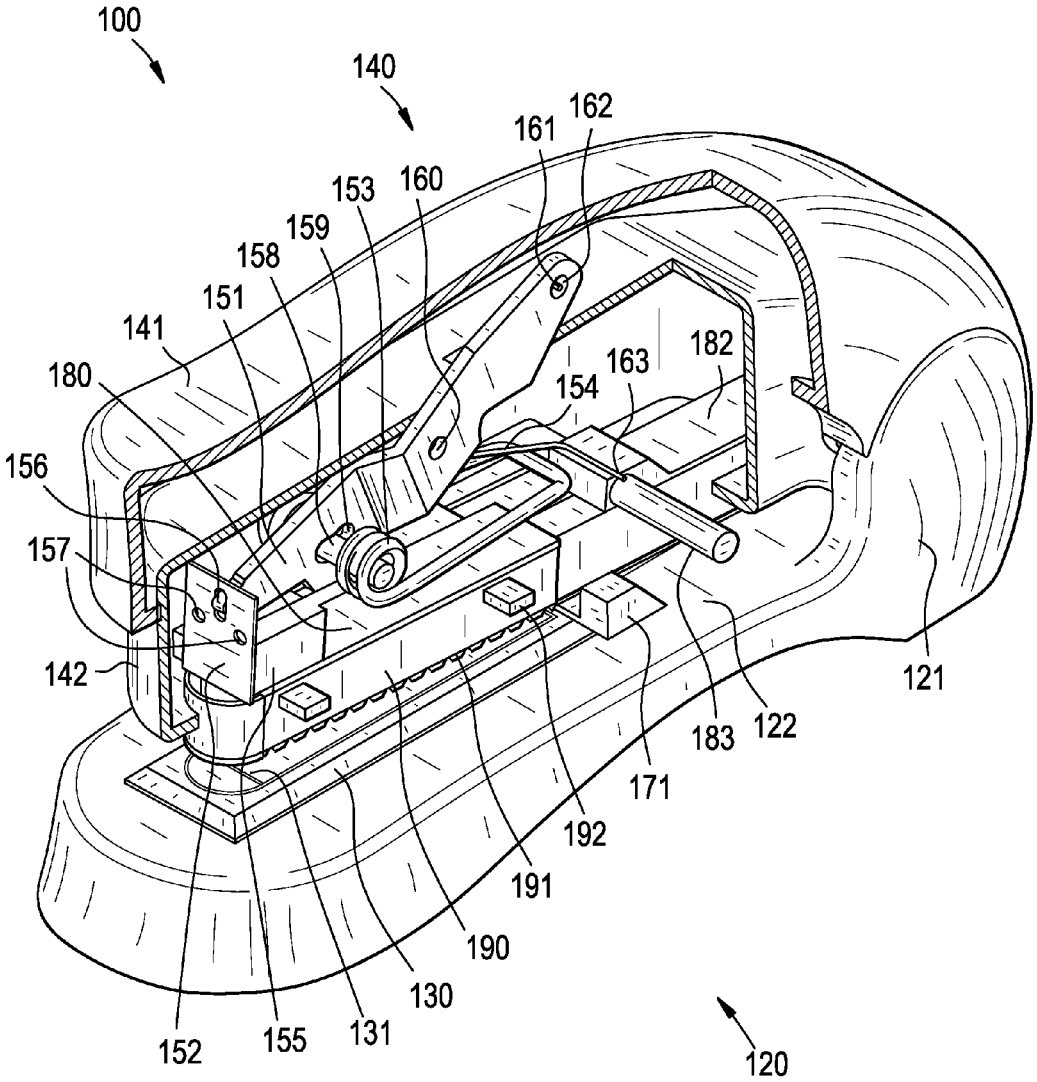
FIG. 11 is a perspective (partially-sectioned) view of a second exemplary apparatus for providing indicator flags in accordance with an embodiment of the present invention.
Figure 12:
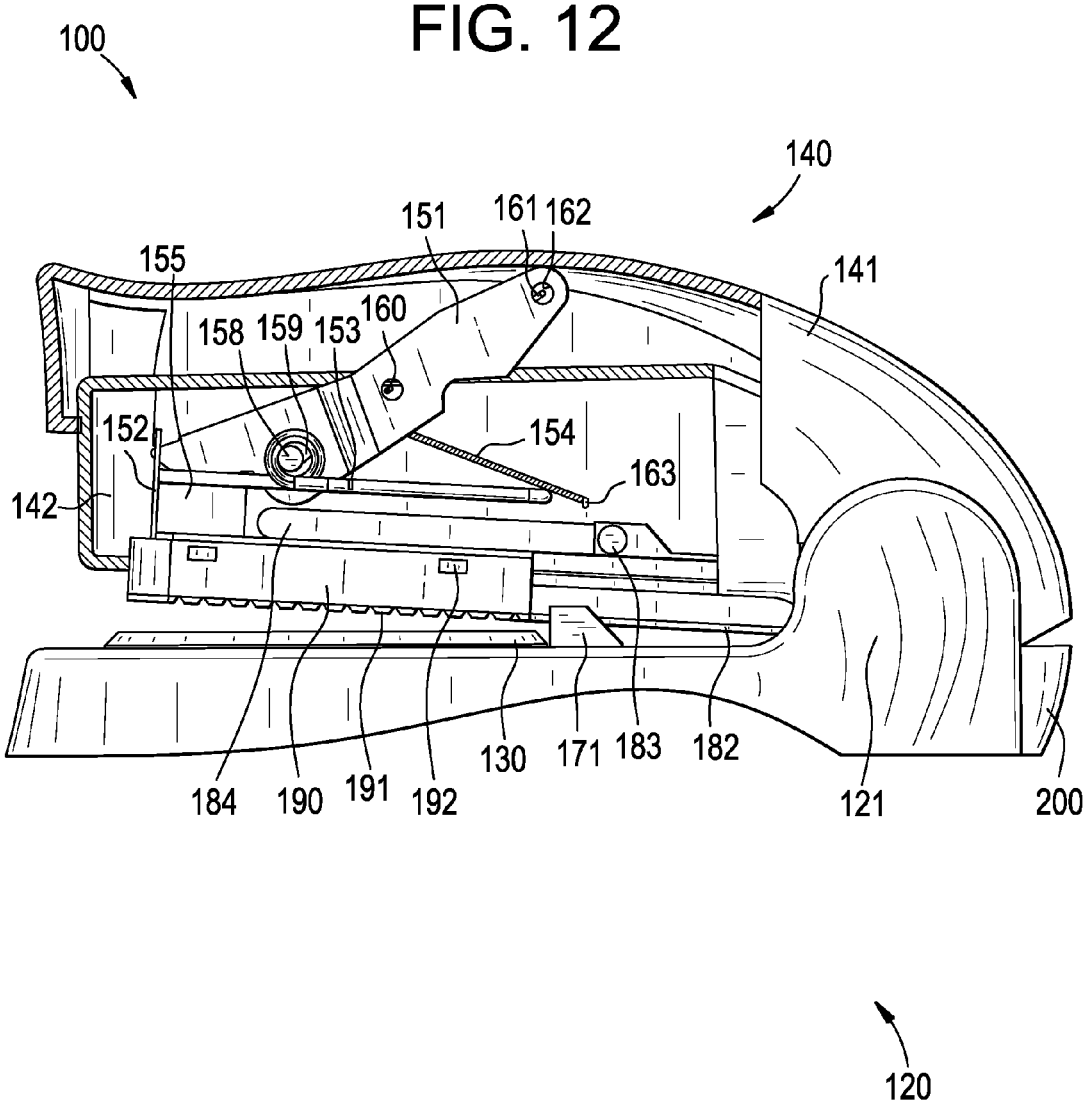
FIG. 12 is a side (partially-sectioned) view of a second exemplary apparatus for providing indicator flags in accordance with an embodiment of the present invention.
Figure 13:
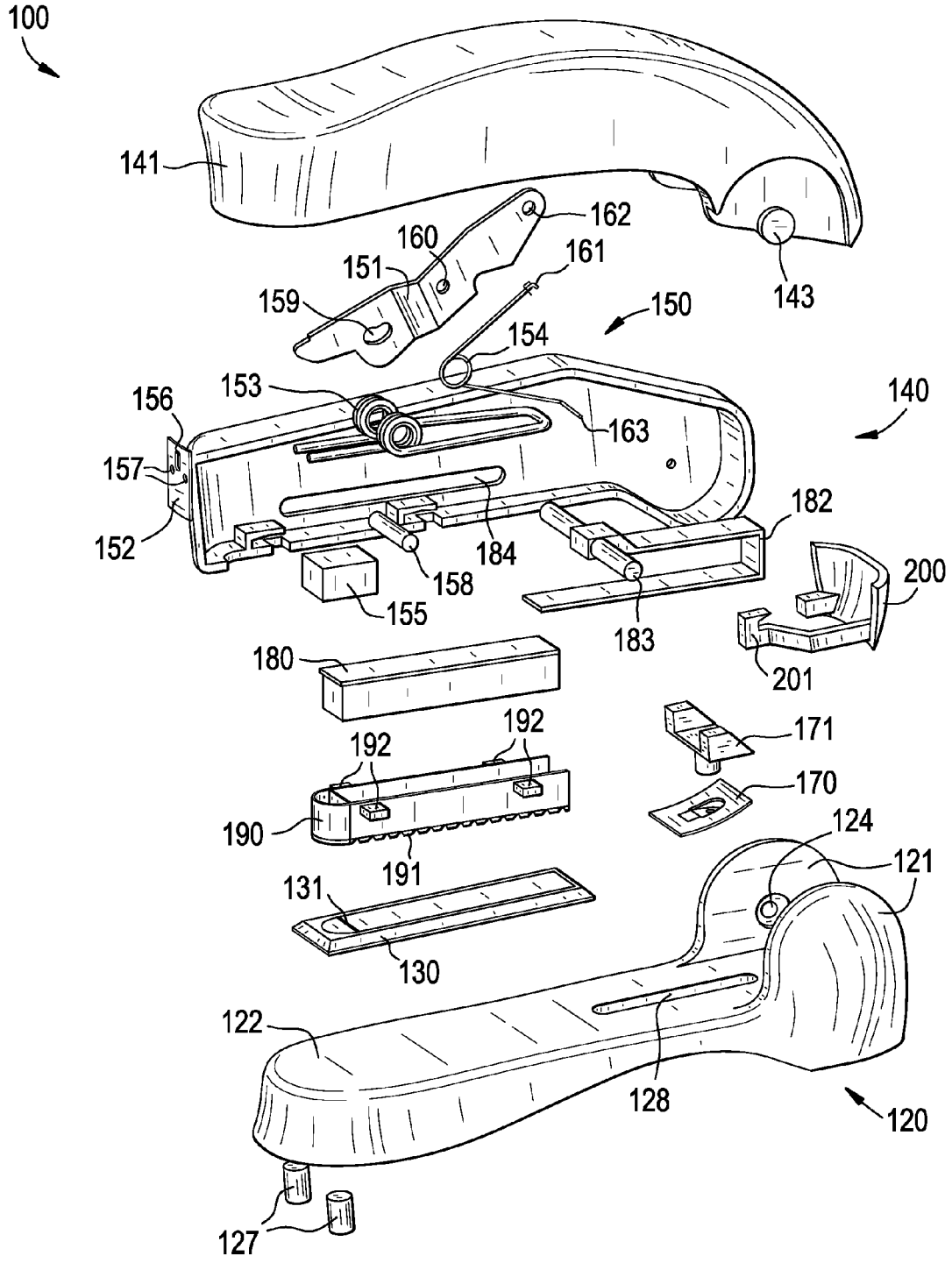
FIG. 13 is an exploded (partially-sectioned) view of a second exemplary apparatus for providing indicator flags in accordance with an embodiment of the present invention.
Figure 14:
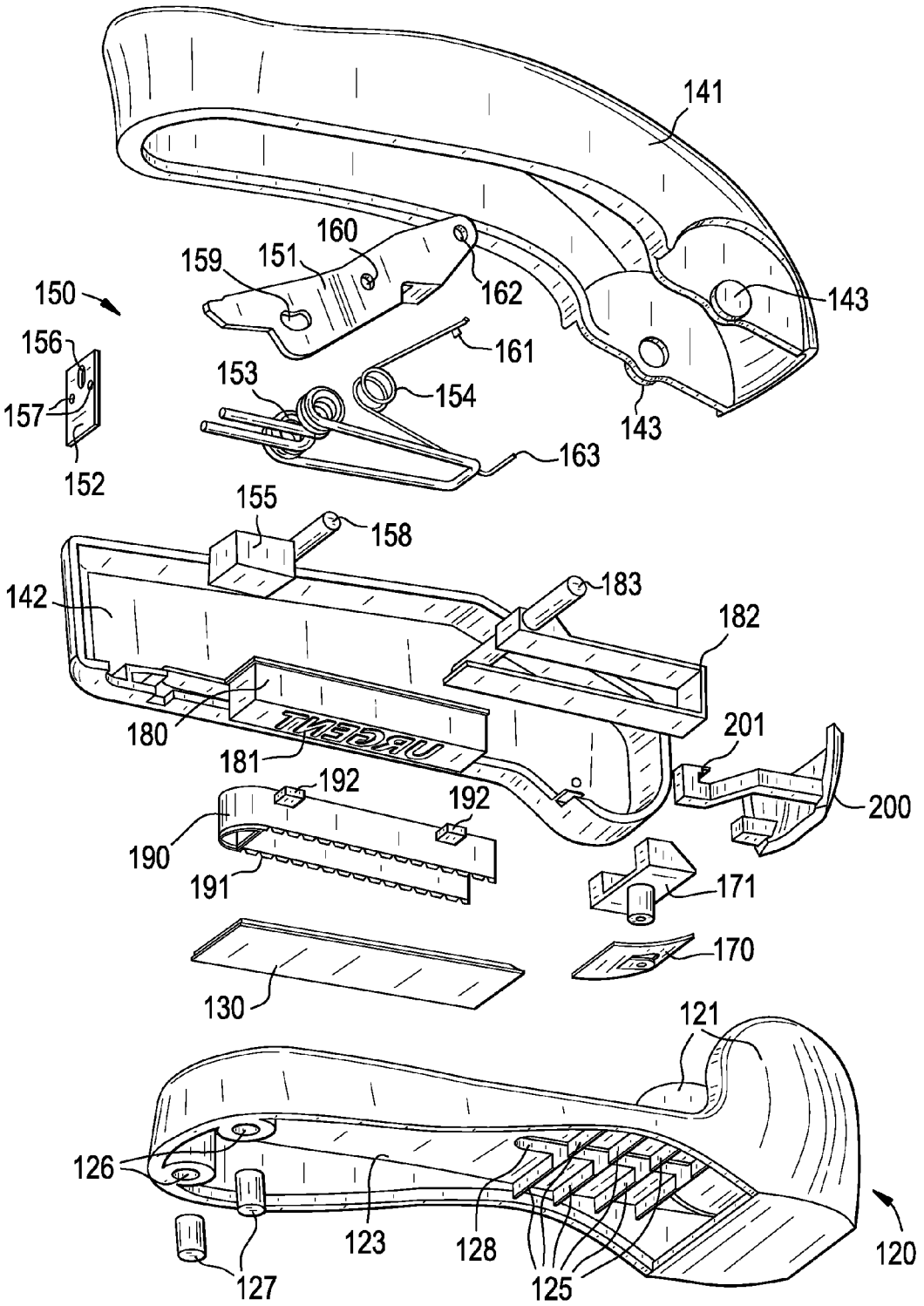
FIG. 14 is an exploded (partially-sectioned) view of a second exemplary apparatus for providing indicator flags in accordance with an embodiment of the present invention.
Figure 15:
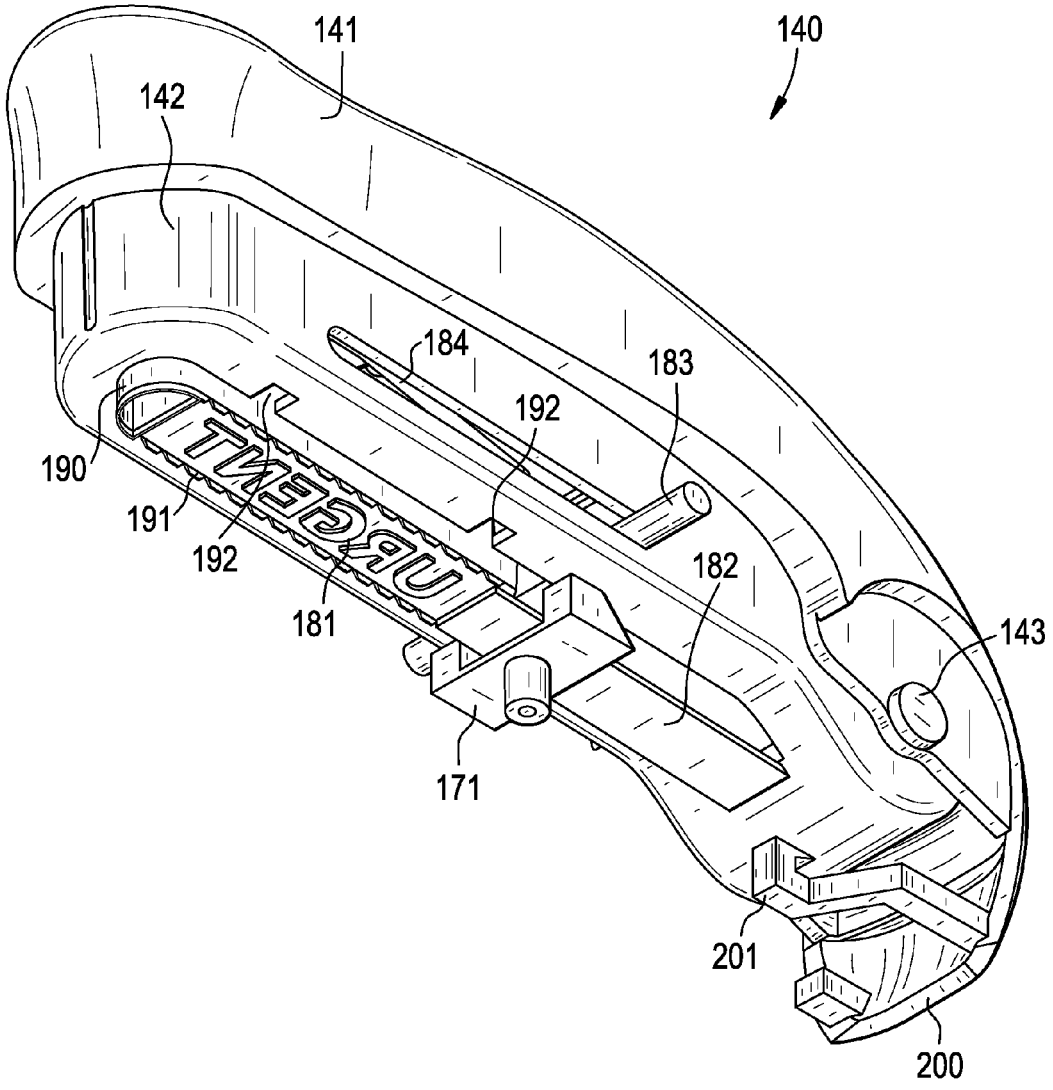
FIG. 15 is a perspective view of an exemplary upper-portion of a second exemplary apparatus for providing indicator flags in accordance with an embodiment of the present invention.

FIGS. 7 and 10 are perspective views of a second exemplary apparatus 100 for providing indicator flags in accordance with an embodiment of the present invention. FIGS. 8-9 are side views of a second exemplary apparatus 100 for providing indicator flags. FIGS. 11-12 are partially-sectioned views of a second exemplary apparatus 100 for providing indicator flags. FIGS. 13-14 are exploded (partially-sectioned) views of a second exemplary apparatus 100 for providing indicator flags. FIG. 15 is a perspective view of an exemplary upper-portion of a second exemplary apparatus 100 for providing indicator flags.

Referring to FIGS. 7-15, an apparatus 100 for providing indicator flags is illustrated. The apparatus 100 comprises a base 120 and an upper portion 140. In various embodiments, the apparatus 10 may be a handheld apparatus and/or may be operated by placing the base 20 on a flat surface, among other things.

The base 120 comprises pivot arms 121, upper surface 122 and lower surface 123. The inner surfaces of pivot arms 121 include pivot holes 124. The lower surface 123 of base 120 includes stop ridges 125, stabilizer holes 126 and stabilizers 127. Stabilizers 127 may be inserted into stabilizer holes 126 to level the base 120 and prevent the base 120 from sliding.

The upper surface 122 of the base 120 includes a slide notch 128. A distance stop 171 extends from the upper surface 122 of the base 120 through the slide notch 128 and is coupled to a distance stop tab 170 at the lower surface 123 of the base 120. Depressing the distance stop 171 causes the distance stop 171 and the distance stop tab 170 to be movable in the slide notch 128 without interference from the stop ridges 125. The distance stop 171 allows the position of a tab being cut into an item using apparatus 100 to be adjustably selected. The stop ridges 125 are operable to secure the coupled distance stop 171 and distance stop tab 170 at the selected position corresponding with one of the plurality of stop ridges 125. For example, setting the distance stop 171 such that the distance stop tab 170 is secured at a stop ridge 125 toward the front of apparatus 100 allows a flag to be cut near an edge of an item such that the flag, when in an open position, extends at a longer distance beyond the item edge as described in U.S. patent application Ser. No. 13/205,173 by Mazursky. As another example, setting the distance stop 171 such that the distance stop tab 170 is secured at a stop ridge 125 toward the back of apparatus 100 allows a flag to be cut farther from the edge of the item such that the flag, when in an open position, extends at a shorter distance beyond the item edge as also described in U.S. patent application Ser. No. 13/205,173 by Mazursky.

A cutting base 130 comprising cutting groves 131 is attached to the upper surface 122 of the base 120. The cutting groves 131 correspond to blades 191 of the cutting blade 190 as described in further detail below.

The upper portion 140 comprises a push lever body 141 and a housing 142. The push lever body 141 includes pivot knobs 143 that couple with pivot holes 124 of the inner surfaces of pivot arms 121 such that the upper portion 140 is rotatably attached to the base 120.

In various embodiments, one or more of the push lever body 141 and housing 142 may house a hammer device 150 comprising a hammer arm 151, a hammer plate 152, a double spring loop 153, a single spring loop 154, and a hammer block 155. The hammer plate 152 comprises a notch 156 operable to receive an end of the hammer arm 151, and spring holes 157 operable to receive the ends of the double spring loop 153. The hammer plate 152 may be slidably attached in grooves of the housing 142.

A pin 158, or any other suitable attachment mechanism, may extend through the double spring loop 153 and a first hole 159 in the hammer arm 151. The hammer arm 151 may contact an inner surface of the push lever body 141 such that when the push lever body 141 is depressed, the hammer arm 151 may pivot at the pin 158. As the hammer arm 151 pivots at the pin 158, the hammer plate 152 slides upward in grooves of the housing 142 until the end of the hammer arm 151 detaches from the notch 156. The depression of the push lever body 141 and the pivoting of the hammer arm 151 about the pin 158 creates a downward force of the hammer arm 151 and the double spring loop 153 on the hammer block 155 causing the upper portion 140 to pivot downward toward the base 120.

Certain embodiments provide a pin (not shown), or any other suitable attachment mechanism, that extends through the single spring loop 154 and a second hole 160 in the hammer arm 151. A first end 161 of the single spring loop 154 may attach to the hammer arm 151 at a third hole 162. A second end 163 of the single spring loop 154 attaches to the housing 142. After depression of the push lever body 141 causes the hammer arm 151 to pivot at the pin 158 and detach from notch 156 of the hammer plate 152, the single spring loop 154 biases the hammer arm 151 toward the hammer plate 152 to reattach the hammer arm 151 and hammer plate 152 at notch 156 after the push lever body 141 is released.

In certain embodiments, the hammer device 150 may provide additional force for providing a press cut (e.g., where blades 191 of the cutting blade 190 simultaneously cut through the item). In various embodiments, the hammer device 150 may not be implemented into the apparatus 100. For example, in embodiments where a roll cut (e.g., where blades 191 of the cutting blade 190 roll across item to make the cut) is implemented, the additional force provided by the hammer device 150 may not be necessary.

In various embodiments, the housing 142 may also house an ink pad 180, an ink cover 182, and the cutting blade 190, among other things. In certain embodiments, the ink pad 180 comprises a stamp 181. In various embodiments, the ink pad 180 may be removable. For example, if the ink pad 180 dries out, if a different ink color is desired, or if a different stamp 181 is desired, among other things, the ink pad 180 may be replaced by a new and/or different ink pad 180. The ink cover 182 is operable to slidably wrap around and cover the ink pad 180 to prevent the ink pad 180 from drying out when not in use. The ink cover 182 comprises a handle 183 extending through slide notches 184 in the housing 142 and operable to slide between an open position (i.e., the ink pad 180 exposed as illustrated in FIG. 9) and a closed position (i.e., the ink pad 180 covered). In certain embodiments, the ink pad 180 may fit between blades 191 of the cutting blade 190. The ink pad 180 may be detachably coupled to the cutting blade 190 and/or the housing 142, among other things, and may be removable from the underside of the housing 142, for example.

The cutting blade 190 comprises blades 191 and attachment tabs 192. In certain embodiments, the blades 191 may include perforation blades, aperture blades, score blades, and/or any other suitable blades for cutting a flag in an item as described, for example, in U.S. patent application Ser. No. 13/205,173 by Mazursky. In various embodiments, the ink pad 180 may detachably affix between blades 191 of the cutting blade 190. The cutting blade 190 is detachably coupled to the housing 142 by attachment tabs 192. For example, the attachment tabs 192 may couple to grooves in the housing 142, or any other suitable attachment mechanism. In certain embodiments, the cutting blade 190 may be removable. For example, if blades 191 of the cutting blade 190 become worn or if a different blade configuration is desired, the cutting blade 190 may be replaced by a new and/or differently configured cutting blade 190. The cutting blade 190 may be removable from the underside of the housing 142, for example.

In certain embodiments, the housing 142 comprises a retractable hook 200. For example, as illustrated in FIGS. 13-15, the retractable hook 200 comprises a hook stop 201. In various embodiments, the retractable hook 200 may pull out from the housing 142 (e.g., similar to a drawer) until stopped by the hook stop 201. In other embodiments, the hook 200 may rotate, among other things, out of the housing 142. Further, certain embodiments provide a hook (not shown) attached to and extending from the back portion of the housing 142. The various hook embodiments may be provided to hang or otherwise provide a mechanism to store the apparatus 100 when not in use. Additionally and/or alternatively, magnets (not shown) may be provided on the lower surface 123 of the base 120 for storing the apparatus 100.

In operation, a desired length an indicator flag is to extend beyond an edge of an item is selected by depressing the distance stop 171 and sliding the distance stop 171 in the slide notch 128 to a position corresponding with one of the plurality of stop ridges 125. The selected stop ridge 125 is operable to secure the coupled distance stop 171 and distance stop tab 170 at the selected position. If it is desired that the indicator flag includes an ink stamp, ink cover 182 is moved to an open position using the handle 183. The item is then inserted between the upper portion 140 and the base 120 until the inserted edge of item abuts the distance stop 171. Once the item is properly inserted and aligned in the apparatus 100, the push lever body 141 is depressed. The hammer arm 151 may contact an inner surface of the push lever body 141 such that when the push lever body 141 is depressed, the hammer arm 151 may pivot at the pin 158. As the hammer arm 151 pivots at the pin 58, the hammer plate 152 slides upward in grooves of the housing 142 until the end of the hammer arm 151 detaches from notch 156. The depression of the push lever body 141 and the pivoting of the hammer arm 151 about the pin 158 creates a downward force of the hammer arm 151 and the double spring loop 153 on the hammer block 155 causing the upper portion 140 to pivot downward toward the base 120.

As the upper portion 140 pivots downward toward the base 120, blades 191 of the cutting blade 190 cut an indicator flag into the item and mate with grooves 131 of the cutting base 130. If the ink cover 182 is in an open position, the ink pad 180 and stamp 181 provide an ink stamp to the indicator flag as the indicator flag is being cut by blades 191 of the cutting blade 190. After depression of the push lever body 141 causes the hammer arm 151 to pivot at the pin 158 and detach from notch 156 of the hammer plate 152, the single spring loop 154 biases the hammer arm 151 toward the hammer plate 152 to reattach the hammer arm 151 and hammer plate 152 at notch 156 after the push lever body 141 is released. After the push lever body 141 is released, the item with the indicator flag (and optionally, ink stamp) may be removed from the apparatus 100. Once a user is finished using the apparatus 100, the apparatus 100 may be stored using the hook 200, or any other suitable storage mechanism. For example, the retractable hook 200 may be pulled out from the housing 142 until stopped by the hook stop 201. The apparatus 100 may then be hung using the hook 200.

Various embodiments provide an apparatus 10, 100 for integrating an indicator flag into an item. The apparatus 10, 100 comprises an upper portion 30, 140 and a base 20, 120. The upper portion 30, 140 comprises a cutting blade 35, 190 and a first attachment 36, 143. The cutting blade 35, 190 is operable to cut the indicator flag into the item. The base 20, 120 comprises a second attachment 25, 124 and one or more cutting grooves 22, 131. The second attachment 25, 124 is operable to couple with the first attachment 36, 143 such that upper portion 30, 140 is movable towards the base 20, 120. The one or more cutting grooves 22, 131 are operable to mate with the cutting blade 35, 190 when the upper portion 30, 140 is depressed and the upper portion 30, 140 moves towards the base 20, 120.

In certain embodiments, the base 20, 120 comprises one ore more notches 23, 128 and a distance stop 24, 171. The one or more notches 23, 128 are operable to receive the distance stop 24, 171 for selecting a position of the indicator flag on the item.

In various embodiments, the one or more cutting grooves 22, 131 are integrated into an upper surface 21, 122 of the base 20, 120.

In certain embodiments, the apparatus 10, 100 comprises a cutting base 130. The one or more cutting grooves 22, 131 are integrated into the cutting base 130. The cutting base 130 is detachably coupled to an upper surface 21, 122 of the base 20, 120.

In various embodiments, the cutting blade 35, 190 comprises one of a plurality of cutting blade configurations. The one or more cutting grooves 22, 131 comprise a plurality of cutting grooves 22, 131 configured to mate with the plurality of cutting blade configurations.

In certain embodiments, the upper portion 30, 140 comprises a stamp 33, 181. The stamp 33, 181 comprises an ink pad 34, 180 operable to stamp the indicator flag when the upper portion 30, 140 is depressed and the upper portion 30, 140 moves towards the base 20, 120.

In various embodiments, the stamp 33, 181 is detachably coupled to the upper portion 30, 140.

In certain embodiments, the cutting blade 35, 190 comprises one or more of a perforation blade, an aperture blade, and a score blade.

In various embodiments, the cutting blade 35, 190 is detachably coupled to a bottom surface 32, 142 of the upper portion 30, 140.

In certain embodiments, the apparatus 10, 100 comprises a motor configured to extend the cutting blade 35, 190 towards an upper surface 21, 122 of the base 20, 120 upon activation.

In various embodiments, inserting the item into the apparatus 10, 100 activates a switch configured to activate the motor.

In certain embodiments, the base 20, 120 comprises stabilizers 127 operable to prevent the base 20, 120 from sliding.

In various embodiments, the base 20, 120 comprises a notch 23, 128, a distance stop 24, 171, a distance stop tab 170, and a plurality of stop ridges 125. The distance stop 24, 171 extends through the notch 23, 128 and is coupled to the distance stop tab 170. The plurality of stop ridges 125 are operable to secure the distance stop 24, 171 and the distance stop tab 170 at a selectable position corresponding with one of the plurality of stop ridges 125.

In certain embodiments, the upper portion 30, 140 comprises a push lever body 141 and a housing 142.

In various embodiments, at least one of the push lever body 141 and the housing 142 houses a hammer device 150 comprising a hammer arm 151, a hammer plate 152, a double spring loop 153, a single spring loop 154, and a hammer block 155.

In certain embodiments, the hammer plate 152 is slidably attached to the housing 142 and is operable to receive the hammer arm 151 and the double spring loop 153.

In various embodiments, the hammer arm 151 is pivotably attached to the double spring loop 153.

In certain embodiments, the hammer arm 151 contacts the push lever body 141 such that when the push lever body 141 is depressed: the hammer arm 151 pivots, the hammer plate 152 slides upward in the housing 142 until the hammer arm 151 detaches from the hammer plate 152, the hammer arm 152 and double spring loop 153 are forced downward on the hammer block 155, and the upper portion 30, 140 pivots downward toward the base 20, 120.

In various embodiments, the single spring loop 154 is attached to the hammer arm 151 and the housing 142. The single spring loop 154 biases the hammer arm 151 toward the hammer plate 152 to reattach the hammer arm 151 and hammer plate 152 when the push lever body 141 is released.

In certain embodiments, the upper portion 30, 140 comprises an ink pad cover 182 that slidably wraps around the ink pad 34, 180 when in a closed position.

In various embodiments, the ink pad cover 182 comprises a handle 183 operable to slide between an open position and the closed position. The ink pad 34, 180 is exposed when the handle 183 is in the open position.

In certain embodiments, the housing 142 comprises a retractable hook 200 that is housed within the housing 142 when in a closed position and extends from the housing 142 when in an open position.

In various embodiments, a lower surface 123 of the base 20, 120 comprises at least one magnet.

While the invention has been described with reference to certain embodiments, it may be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention may include all embodiments falling within the scope of the appended claims.

The invention claimed is:

1. An apparatus for integrating an indicator flag into an item having a perimeter edge, the apparatus comprising:

an upper portion comprising:

an indicator flag-shaped cutting blade operable to cut the indicator flag into the item, wherein the indicator flag cut into the item by the indicator flag-shaped cutting blade is a portion of the item that at least partially remains attached to the item at an attachment point, and wherein the indicator flag is foldable over the attachment point such that at least a portion of the indicator extends beyond the perimeter edge of the item, a stamp comprising an ink pad, the stamp positioned within the indicator flag-shaped cutting blade, and a first attachment; and a base comprising:

a second attachment operable to couple with the first attachment of the upper portion such that upper portion is movable towards the base, and at least one cutting groove operable to mate with the indicator flag-shaped cutting blade when the upper portion is depressed and the upper portion moves towards the base.

2. The apparatus of claim 1, wherein the base comprises at least one notch and a distance stop, wherein the at least one notch is operable to receive the distance stop for selecting a position of the indicator flag on the item.

3. The apparatus of claim 1, wherein the at least one cutting groove is integrated into an upper surface of the base.

4. The apparatus of claim 1, comprising a cutting base, wherein the at least one cutting groove is integrated into the cutting base, and wherein the cutting base is detachably coupled to an upper surface of the base.

5. The apparatus of claim 1, wherein the indicator flag-shaped cutting blade comprises one of a plurality of cutting blade configurations, and wherein the at least one cutting groove comprises a plurality of cutting grooves configured to mate with the plurality of cutting blade configurations.

6. The apparatus of claim 1, wherein the ink pad operable to stamp the indicator flag when the upper portion is depressed and the upper portion moves towards the base.

7. The apparatus of claim 6, wherein the stamp is detachably coupled to the upper portion.

8. The apparatus of claim 1, wherein the indicator flag-shaped cutting blade comprises at least one of a perforation blade, an aperture blade, and a score blade.

9. The apparatus of claim 1, wherein the indicator flag-shaped cutting blade is detachably coupled to a bottom surface of the upper portion.

10. The apparatus of claim 1, comprising a motor configured to extend the indicator flag-shaped cutting blade towards an upper surface of the base upon activation.

11. The apparatus of claim 10, comprising a switch configured to activate the motor when the item is inserted into the apparatus.

12. The apparatus of claim 1, wherein the base comprises stabilizers operable to prevent the base from sliding.

13. The apparatus of claim 1, wherein the base comprises a notch, a distance stop, a distance stop tab, and a plurality of stop ridges, wherein the distance stop extends through the notch and is coupled to the distance stop tab, and wherein the plurality of stop ridges are operable to secure the distance stop and the distance stop tab at a selectable position corresponding with one of the plurality of stop ridges.

14. The apparatus of claim 1, wherein the upper portion comprises a push lever body and a housing.

15. The apparatus of claim 14, wherein at least one of the push lever body and the housing houses a hammer device comprising a hammer arm, a hammer plate, a double spring loop, a single spring loop, and a hammer block.

16. The apparatus of claim 15, wherein the hammer plate is slidably attached to the housing and is operable to receive the hammer arm and the double spring loop.

17. The apparatus of claim 16, wherein the hammer arm is pivotably attached to the double spring loop.

18. The apparatus of claim 16, wherein the hammer arm contacts the push lever body such that when the push lever body is depressed:

the hammer arm pivots, the hammer plate slides upward in the housing until the hammer arm detaches from the hammer plate, the hammer arm and double spring loop are forced downward on the hammer block, and the upper portion pivots downward toward the base.

19. The apparatus of claim 18, wherein the single spring loop is attached to the hammer arm and the housing, and wherein the single spring loop biases the hammer arm toward the hammer plate to reattach the hammer arm and hammer plate when the push lever body is released.

20. The apparatus of claim 6, wherein the upper portion comprises an ink pad cover that slidably wraps around the ink pad when in a closed position.

21. The apparatus of claim 20, wherein the ink pad cover comprises a handle operable to slide between an open position and the closed position, wherein the ink pad is exposed when the handle is in the open position.

22. The apparatus of claim 14, wherein the housing comprises a retractable hook that is housed within the housing when in a closed position and extends from the housing when in an open position.

23. The apparatus of claim 1, wherein a lower surface of the base comprises at least one magnet.

* * * * *